US005927514A

United States Patent [19]

Linder

[11] Patent Number: 5,927,514

[45] Date of Patent: Jul. 27, 1999

[54] INSTRUMENTATION RACK

[75] Inventor: Steven E. Linder, Portland, Oreg.

[73] Assignee: Anthro Corporation, Tualatin, Oreg.

[21] Appl. No.: 08/971,181

[22] Filed: Nov. 17, 1997

[51] Int. Cl.[6] ..... A47F 5/00

[52] U.S. Cl. ..... 211/26; 211/189; 211/193; 280/79.3

[58] Field of Search ..... 211/26, 189, 182, 211/193, 198; 280/79.3

[56] References Cited

U.S. PATENT DOCUMENTS

| | | | |
|---|---|---|---|
| 3,224,787 | 12/1965 | Andersen | 280/33.99 |
| 3,420,381 | 1/1969 | Bradfield | 211/26 |
| 3,606,019 | 9/1971 | Dubiel | 211/26 |
| 4,129,916 | 12/1978 | Schlesinger et al. | 211/182 X |
| 4,305,509 | 12/1981 | Bhatt | 211/26 |
| 4,360,211 | 11/1982 | Blake | 211/189 X |
| 4,605,988 | 8/1986 | Nienhuis et al. | 361/429 |
| 4,667,833 | 5/1987 | Jamison | 211/198 |
| 4,795,186 | 1/1989 | Tyus | 280/651 |
| 4,923,202 | 5/1990 | Breveglieri et al. | 280/47.35 |
| 4,928,832 | 5/1990 | Overmann | 211/193 X |
| 5,209,356 | 5/1993 | Chaffer | 211/26 |
| 5,323,916 | 6/1994 | Salmon | 211/26 |
| 5,348,324 | 9/1994 | Trotta | 280/35 |
| 5,520,293 | 5/1996 | Hartley | 211/26 X |
| 5,683,001 | 11/1997 | Masuda et al. | 211/26 |

OTHER PUBLICATIONS

STS®, Consoles, Racks & Control Centers (Nov. 1991) entire brochure.

AMCO Modular Enclosure Systems (Catalog 800A) (1992), pp. 43,52,53,59,66,67,69,116.

Middle Atlantic Products Commercial Products Catalog (1992), p. 10.

Winsted® Furniture Catalog (1996), pp. 34,35,43,49, and 77.

A Guide to Emcor® Enclosures (Jan. 1993), pp. 3–7.

*Primary Examiner*—Robert W. Gibson, Jr.

*Attorney, Agent, or Firm*—Stoel Rives LLP

[57] ABSTRACT

An instrumentation rack (10) includes a rectangular base frame (12) and a slanted support structure (13) having a pair of bent transverse braces (54). The bent braces (54) can be formed in a variety of heights and with a range of medial bends (70) to provide a variety of shapes for the instrumentation rack (10). A pair of straight mounting rails (76) are longitudinally aligned along a slant angle (72) preferably determined by the angle of medial bends (70). The slant of the mounting rails (76) permits the face plates, including controls and monitors, of equipment to be angled advantageously for operator comfort, access, and visibility. This angled arrangement permits equipment to be ergonomically stored and operated below desk level.

20 Claims, 4 Drawing Sheets

10
99
100
92
94
96
102
98
112
74
108
72
68
76
104
54
80
70
106
90
64
50
48
33
34
32
38
46
52
42
56
18
62
58
30
110
88
29
60
28
86
87
84
20
22
26
24
14
82

INSTRUMENTATION RACK

TECHNICAL FIELD

Present invention relates to instrumentation racks and, in particular, to instrumentation racks that provide slanted mounting surfaces for equipment.

BACKGROUND OF THE INVENTION

Conventional instrumentation racks typically provide vertical mounting surfaces that require instruments or equipment, such as oscilloscopes, to be mounted such that their face plates, including control panels and monitors, are oriented perpendicular to the ground. These racks work well for mounting equipment above desk level. However, they are not ergonomic for mounting equipment below desk level because off-axis visibility of low perpendicular face plates is relatively poor and manipulation of the control panels is awkward. Thus, the lower space on conventional instrumentation racks is often underutilized for equipment having control panels or monitors. Often, additional instrumentation racks are required to house equipment above desk level that could more efficiently be stored below desk level.

SUMMARY OF THE INVENTION

An object of the present invention is, therefore, to provide an instrumentation rack that includes a slanted mounting structure such that controls and monitors of equipment mounted thereon are ergonomically accessible and visible.

Another object of the invention is to facilitate storage of equipment on a lower portion of an instrumentation rack.

A further object of the invention is to provide such an instrumentation rack that can be largely formed from pairs of common interchangeable parts.

Yet another object of the invention is to provide a variety of shapes for an instrumentation rack that can be formed from a minimum number of differentiating parts.

The present invention preferably employs a rectangular base frame and a slanted support structure that includes a pair of bent transverse braces. The bent transverse braces may comprise a variety of heights and slant angles that are paired with the shape of a slant strut in the rectangular base frame to provide a variety of shapes for the instrumentation rack.

A slanted mounting structure that is positioned longitudinally along the slant angle permits equipment to dip below desk height and, if desirable, below the level of the rectangular base frame. The face plates of such equipment are angled advantageously for operator access and visibility.

Additional objects and advantages of the invention will be apparent from the following detailed description of preferred embodiments thereof, which proceeds with reference to the accompanied drawings.

DETAILED DESCRIPTION OF PREFERRED EMBODIMENTS

Figure 1:
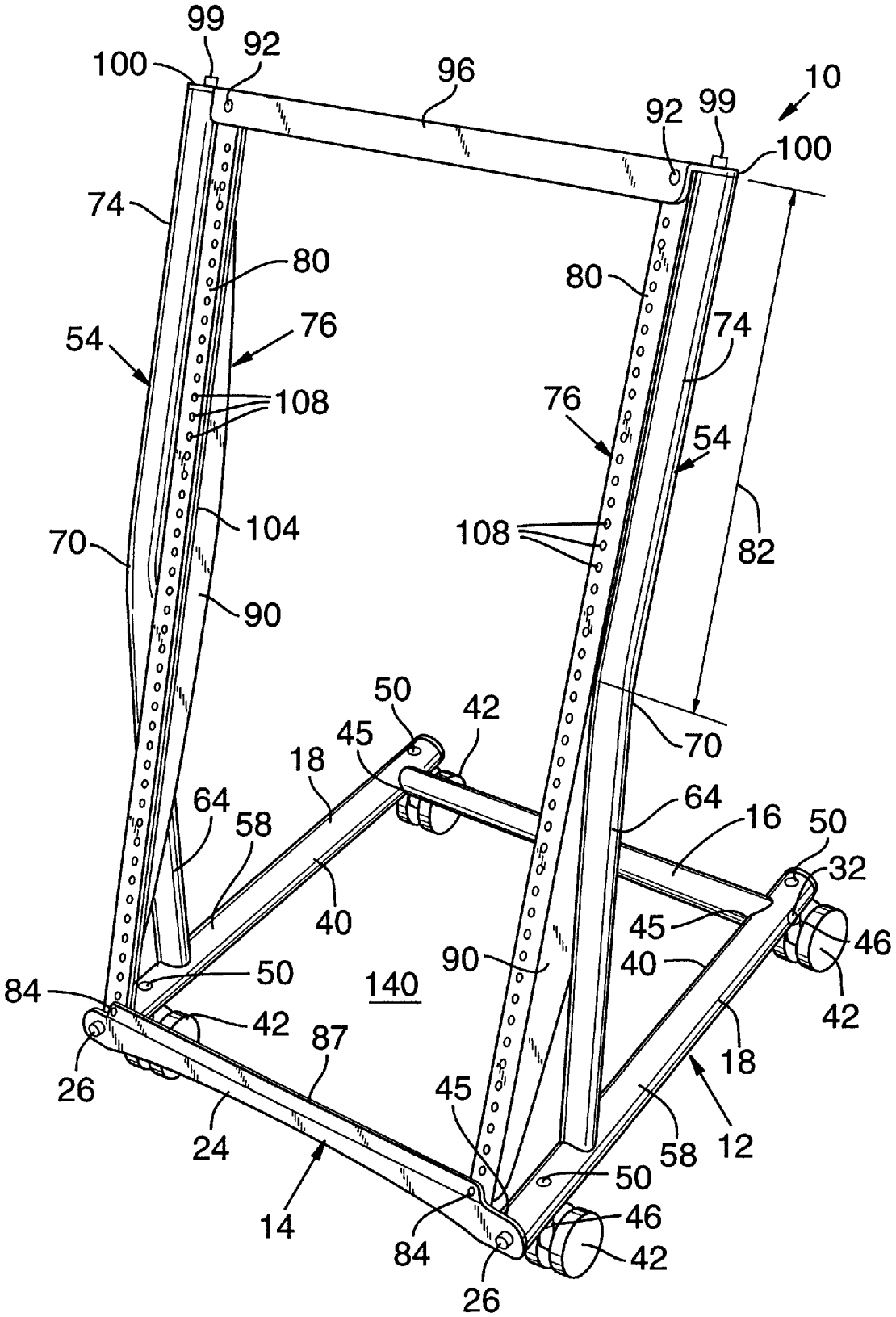
FIG. 1 is a front isometric view of a preferred embodiment of an instrumentation rack of the present invention.
Figure 2:
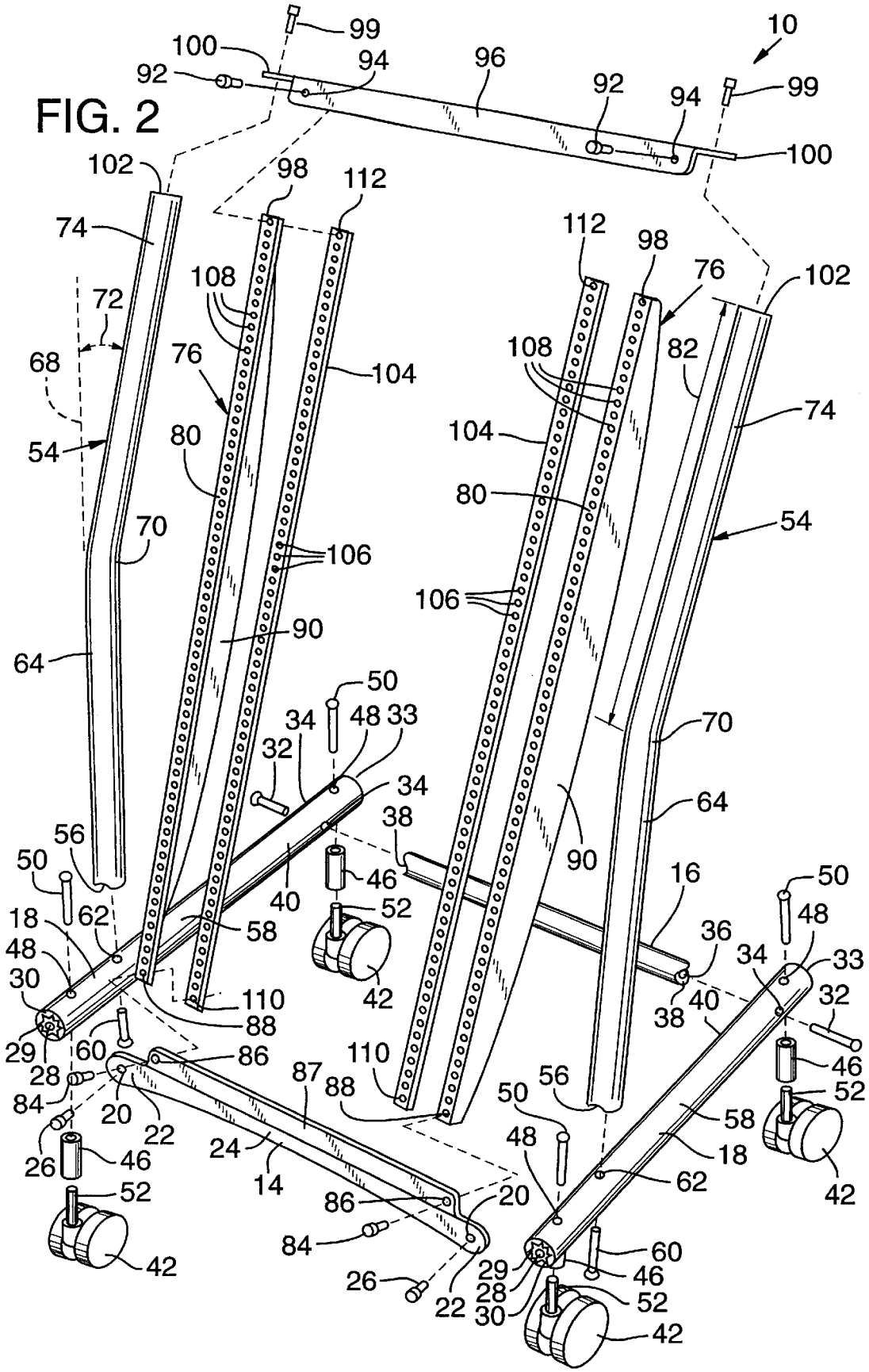
FIG. 2 is an exploded isometric view of the instrumentation rack of FIG. 1.
Figure 3:
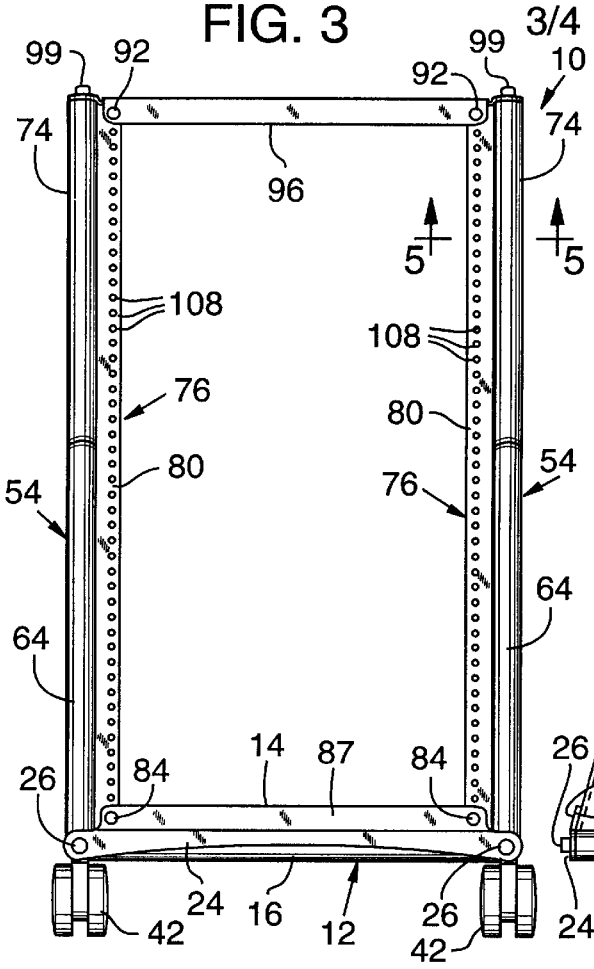
FIG. 3 is a front elevation view of the instrumentation rack of FIG. 1.
Figure 4:
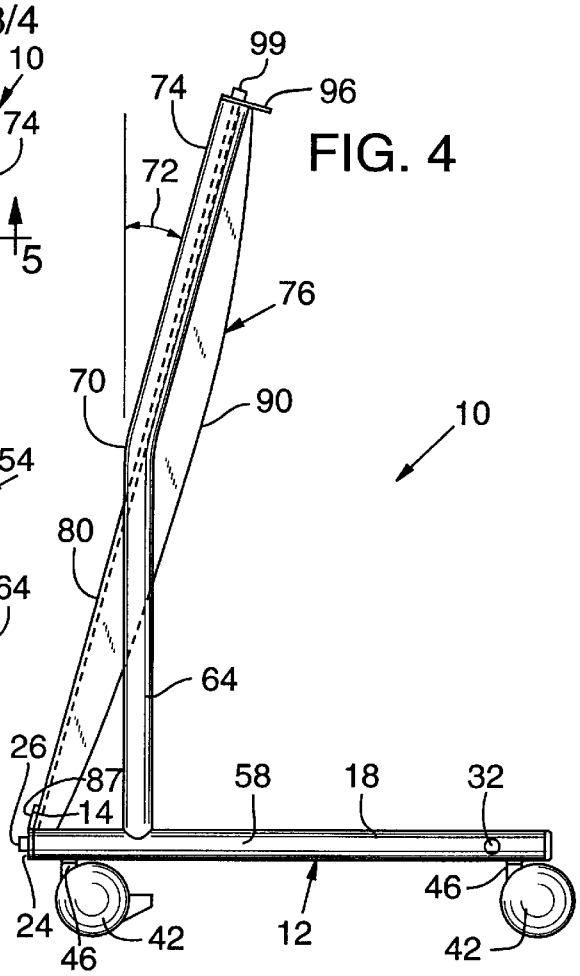
FIG. 4 is a side elevation view of the instrumentation rack of FIG. 1.
Figure 5:
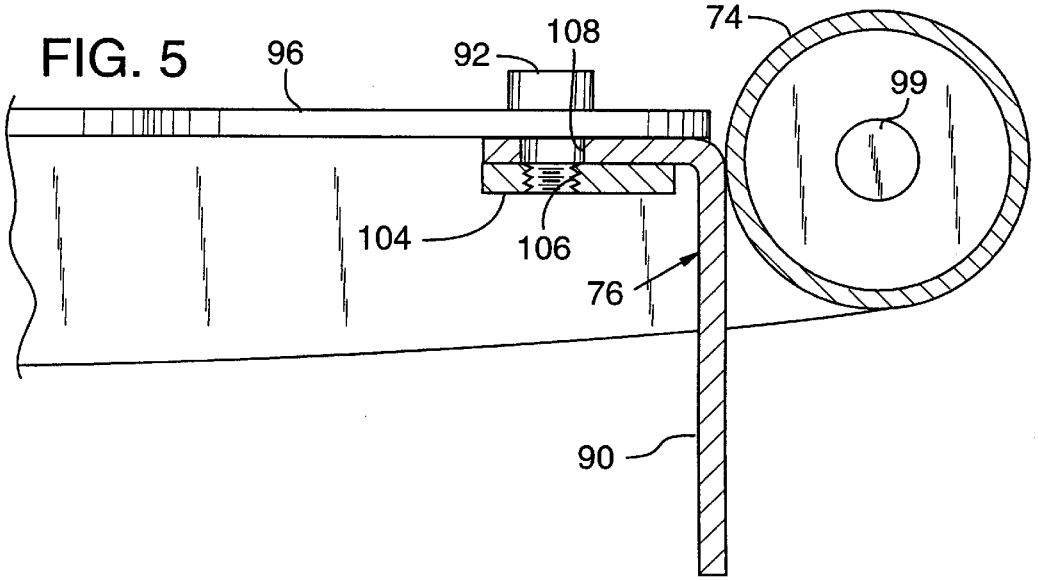
FIG. 5 is a bottom cut-away cross sectional view of the instrumentation rack of FIG. 1.

FIGS. 1–5 show respective front isometric, exploded front isometric, front elevation, side elevation, and bottom cut-away cross sectional views of a preferred embodiment of an instrumentation rack 10 of the present invention. With reference to FIGS. 1–5, instrumentation rack 10 includes a preferably horizontal rectangular base frame 12 that includes a slant strut 14 and a cross strut 16 that are connected to a pair of side struts 18.

A pair of frame holes 20 are symmetrically positioned at tab ends 22 of face 24 of slant strut 14. Frame screws 26 are inserted into frame holes 20 and then into frame holes 28, preferably formed in star nuts 29, in strut ends 30 of side strut 18 to connect slant strut 14 to side struts 18. Preferred star nuts 29 are manufactured by Illinois Tool Works, 952 S. Main Street, Waterbury, Conn. 06721. Metal, plastic, or rubber caps 31 may be inserted into open ends 33 of side struts 18. Frame screws 32 are inserted through a pair of aligned frame holes 34 in side struts 18 and into frame holes 36 in contoured ends 38 of cross strut 16 to connect cross strut 16 between side struts 18. Contoured ends 38 of cross strut 16 are preferably shaped to receive or adjoin the geometrical shape of side 40 of side struts 18.

Slant strut 14 is preferably formed from flat sheet metal but could be made from injection molded plastic. Struts 16 and 18 are preferably metal tubes with a cylindrical cross section, but skilled persons will appreciate that struts 16 and 18 may be solid or semi-filled with square, triangular, or other geometrical cross sections and made of other materials such as plastics. Skilled persons will also appreciate that side struts 18 are designed to be interchangeable and that cross strut 16 is reversible.

Rectangular base frame 12 is preferably supported by four wheels 42 or glides 44 (FIG. 6) connected in proximity to intersections 45 between struts 14, 16, and 18. Wheels 42 are preferably mounted to rectangular base frame 12 by inserting wheel collars 46 into wheel holes 48 in side struts 18 and securing wheel collars 46 to side struts 18 with collar screws 50. Wheel pins 52 of wheels 42 can then be inserted into wheel collars 46. In a preferred embodiment, wheels 42 include two locking casters mounted near slant strut 14 and two nonlocking casters mounted near cross strut 16.

A pair of bent transverse braces 54 have contoured ends 56 that are mounted transversely to surfaces 58 of respective side struts 18. Brace screws 60 are inserted through strut holes 62 in side struts 18 and into brace holes (not shown) in contoured ends 56 of bent transverse braces 54. Contoured ends 56 are preferably shaped to receive or adjoin surfaces 58. Each transverse segment 64 of bent transverse braces 54 has a longitudinal axis 68 that is preferably parallel to an axis (not shown) that is preferably, but not necessarily, vertical and perpendicular to rectangular base frame 12. Each bent transverse brace 54 also has a medial bend 70 that forms a slant angle 72 between longitudinal axis 68 and angled segment 74. Slant angle 72 is preferably less than 30°, more preferably in an inclusive range between 10° and 25°, and most preferably about 15°.

A pair of straight mounting rails 76 are attached to slant strut 14 and adjacent to bent transverse braces 54 such that portions 78 of tapped faces 80 of bent transverse braces 54 extend along length 82 of angled segments 74 at the same slant angle 72 from axis 68.

Slant screws 84 are inserted through slant holes 86 in angle flange 87 of slant strut 14 and through rail holes 88 in tapped faces 80 of mounting rails 76 to secure mounting rails 76 to slant strut 14. Each mounting rail 76 preferably includes a symmetrically tapered L-flange 90. L-flanges 90 are preferably oriented at 90° with respect to tapped faces 80 and are designed to reinforce mounting rails 76 so that they will not bend or buckle under the weight of equipment mounted onto tapped faces 80. Mounting rails 76, including L-flanges 90, are preferably formed from sheet metal and are interchangeable when flipped.

Slant screws 92 are inserted through slant holes 94 in terminal strut 96 and rail holes 98 in mounting rails 76 to secure mounting rails 76 to terminal strut 96. Brace screws 99 are inserted through flange holes (not shown) in flange ends 100 of terminal strut 96 and into brace holes (not shown) in distal ends 102 of angled segments 74 of bent transverse braces 54 to secure terminal strut 96 to bent transverse braces 54.

Tapped strips 104 are mounted behind tapped faces 80 and rest against L-flanges 90 such that tapped holes 106 are collinear with mounting holes 108 in mounting rails 76. Slant screws 84 engage strip holes 110 in tapped strips 104, and slant screws 92 engage strip holes 112 in tapped strips 104 after they penetrate respective holes 88 and 98 in mounting rails 76. Tapped strips 104 are preferably formed from sheet metal or plastics and are interchangeable. Skilled persons will appreciate that tapped strips 104 may be replaced by using square shapes for holes 88, 98, and 108 to engage clip nuts that could be snapped into place.

Skilled persons will appreciate that instrumentation rack 10 is designed to have a minimum number of handed or unique parts. Furthermore, side struts 18 can be designed to be reversible if wheel holes 48 are positioned symmetrically on side struts 18, ends 30 and 33 both contain star nuts 29, and an extra brace screw 60 is symmetrically added to each side strut 18. Similarly, holes 20, 28, 34, 36, 48, 62, 86, 88, 94, 98, 106, 108, 110, and 112 may contain identical diameters and threading so that all of screws 26, 32, 50, 60, 84, 92, and 99 are identical. In a preferred embodiment, however, frame screws 26 and brace screws 99 are identical, frame screws 32 and brace screws 60 are identical, and slant screws 84 and slant screws 92 are identical. Skilled persons will appreciate that other groupings are possible.

The screws are preferably metal machine screws but can be replaced by alternative connecting means, such as by welding. For example, struts 14, 16, and 18 can be welded to at least one adjoining strut or struts 18 can be welded to bent transverse braces 54. Alternatively, or in addition, straight side rails 76 can be welded to segments 74 of bent transverse braces 54. Furthermore, the joints between bent transverse braces 54 and side struts 18 and the joints between slant strut 14 and sides struts 18 can be formed with releasible locking pivots to facilitate storage of instrumentation rack 10, when it is not in use.

Instrumentation rack 110 has a preferred height range of 10–84 inches (25.4–213.4 cm) and a more preferred range of 18.5–72 inches (47–182.9 cm). Most preferred heights for instrumentation rack 110 include 27, 35, 42.5, and 72 inches (68.6, 88.9, 108, and 182.9 cm).

Figure 6:
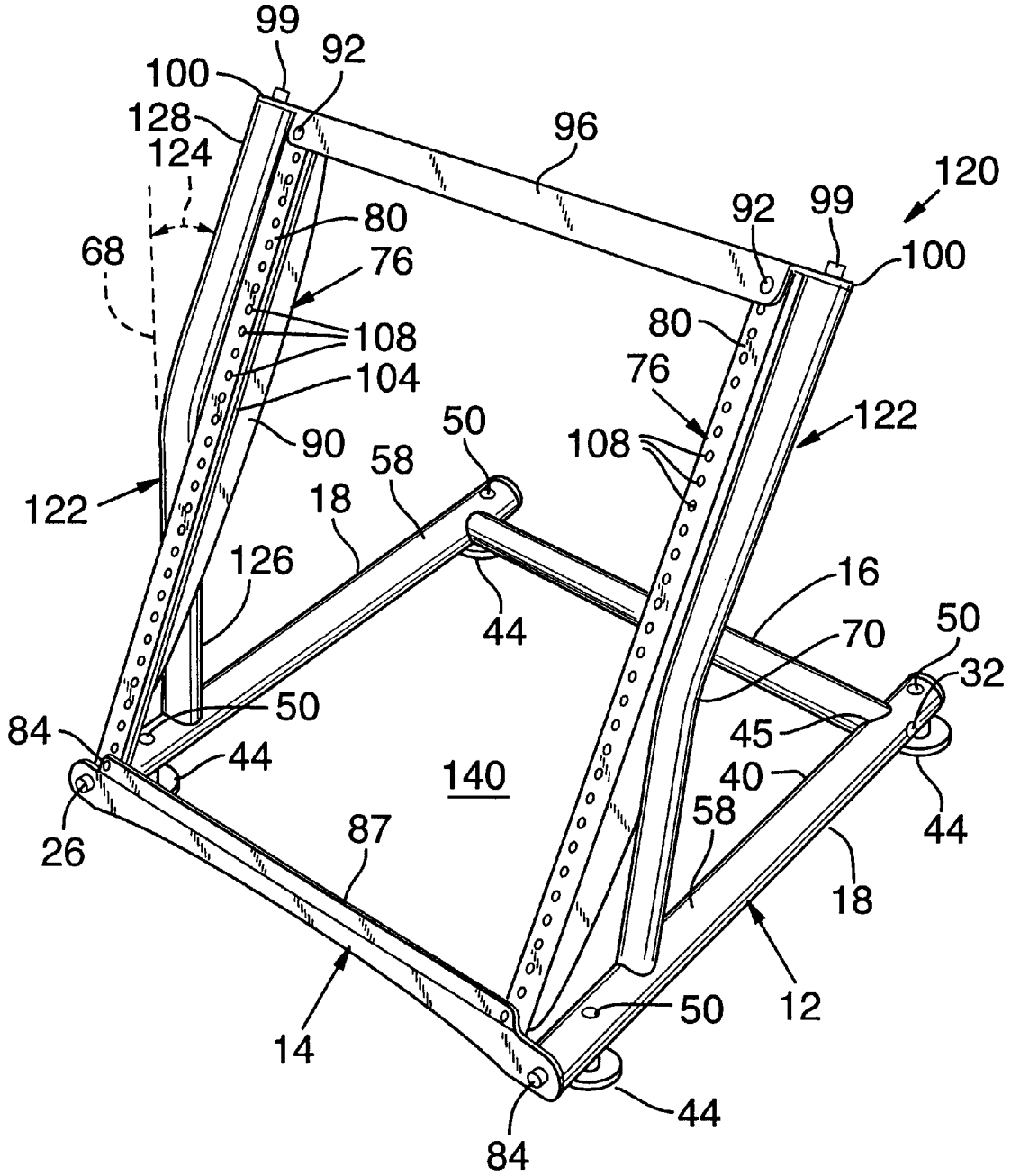
FIG. 6 is an isometric view of an alternative embodiment of an instrumentation rack.

FIG. 6 shows an alternative instrumentation rack 120. With reference to FIG. 6, instrumentation rack 120 can be formed with components that are nearly identical to the components that form instrumentation rack 10. For convenience, certain components that can be interchangeable with the components of instrumentation rack 10 have been provided with the same reference numbers. Bent transverse braces 122 preferably have a small longitudinal dimension and a greater slant angle 124 between longitudinal axis 68 and angled segments 128 than slant angle 72 of bent transverse brace 54. Slant angle 124 has a preferred range of 20° to 40°; the most preferred angle is about 30°. For instrumentation rack 120, the preferred height range is from 10–35 inches (25.4–88.9 cm) with most preferred heights including 18.5, 27, and 35 inches (47, 68.6, and 88.9 cm.) Thus, instrumentation rack 120 can easily fit underneath a desk, shelf, or countertop (about 19 or 20 inches). Instrumentation rack 120 preferably employs slides 44 instead of wheels 42.

An advantage of the present invention is that the modular nature of instrumentation racks 10 and 120 and their components provides a wide variety of shapes with relatively few differentiated components. For example, different heights can be obtained by substituting only braces 54, rails 76, and strips 104. Similarly, slant angles 72 and 124 can be changed by substituting only struts 14 and 96 and braces 54. In addition, the interchangeability and/or reversibility of many of the components facilitate assembly of instrumentation racks 10 and 120. Skilled persons will also appreciate that the narrow vertical profile of braces 54 and rails 76 permit instrumentation racks 10 and 120 to be easily stored as assembled.

Another advantage of instrumentation racks 10 and 120 is that the slant angles 72 and 124 permit equipment to occupy, and even dip below, if desirable, open space 140 defined by rectangular base frame 12.

It will be obvious to those having skill in the art that many changes may be made to the details of the above-described embodiments of this invention without departing from the underlying principles thereof. The scope of the present invention should, therefore, be determined only by the following claims.

I claim:

1. An instrumentation rack, comprising:

a rectangular frame, including a slant strut and a cross strut connected to a pair of side struts; and a slanted, equipment support structure, including a pair of bent braces and a pair of straight side rails, each bent brace being adapted for mounting at a transverse angle to one of the side struts, each bent brace having a medial bend with a segment forming a predetermined slant angle with respect to a vertical plane, each straight side rail being mounted to the slant strut and positioned adjacent to the segments of the bent braces, and each side rail being positioned with its longitudinal axis generally oriented along the slant angle.

2. The instrumentation rack of claim 1 in which the slant, cross, or side struts or bent braces are tubular.

3. The instrumentation rack of claim 1 in which the side struts form first and second intersections with the slant and cross struts, respectively, and in which the rectangular frame is supported by wheels connected in proximity to the first and second intersections.

4. The instrumentation rack of claim 1 in which each member of the pairs of straight side rails, side struts, and bent braces is respectively interchangeable.

5. The instrumentation rack of claim 1 in which the bent braces each have a proximal end and a distal end with respect to the slant strut, and the distal ends of the bent braces are connected to a terminal slant strut.

6. The instrumentation rack of claim 5 in which the straight side rails are connected to the terminal slant strut.

7. The instrumentation rack of claim 1 in which screws or bolts are used to connect the slant, cross, or side struts to each other or to connect the slant strut to the straight side rails or to connect the side struts to the bent braces.

8. The instrumentation rack of claim 1 in which the slant angle is less than or equal to 30°.

9. The instrumentation rack of claim 8 in which the slant angle is less than or equal to 15°.

10. The instrumentation rack of claim 1 in which the straight side rails, the side struts, and the cross strut form common elements of a kit capable of forming a variety of shapes for the instrumentation rack, and paired combinations of the slant strut and the pair of bent braces are adapted for a desired slant angle and determine the shape of the rack.

11. The instrumentation rack of claim 1 in which the slant, cross, or side struts are generally horizontal and a segment of each bent brace is generally vertical.

12. The instrumentation rack of claim 1 in which the slant, cross, or side struts define a perimeter of open space and the slant angle is adapted to permit mounting of equipment such that a portion of the equipment is positioned within the open space between the side struts.

13. The instrumentation rack of claim 4 in which the straight side rails, the side struts, and the cross strut form common elements of a kit capable of forming a variety of shapes for the instrumentation rack, and paired combinations of the slant strut and the pair of bent braces are adapted for a desired slant angle and determine the shape of the rack.

14. The instrumentation rack of claim 4 in which the slant, cross, or side struts define a perimeter of open space and the slant angle is adapted to permit mounting of equipment such that a portion of the equipment is positioned within the open space between the side struts.

15. The instrumentation rack of claim 13 in which the slant, cross, or side struts define a perimeter of open space and the slant angle is adapted to permit mounting of equipment such that a portion of the equipment is positioned within the open space between the side struts.

16. The instrumentation rack of claim 4 in which the slant angle is less than or equal to 30°.

17. The instrumentation rack of claim 12 in which the slant angle is less than or equal to 30°.

18. The instrumentation rack of claim 4 in which the side struts form first and second intersections with the slant and cross struts, respectively, and in which the rectangular frame is supported by wheels connected in proximity to the first and second intersections.

19. The instrumentation rack of claim 10 in which the side struts form first and second intersections with the slant and cross struts, respectively, and in which the rectangular frame is supported by wheels connected in proximity to the first and second intersections.

20. The instrumentation rack of claim 12 in which the side struts form first and second intersections with the slant and cross struts, respectively, and in which the rectangular frame is supported by wheels connected in proximity to the first and second intersections.

* * * * *